US005121868A

United States Patent [19]

Jairam

[11] Patent Number: 5,121,868

[45] Date of Patent: Jun. 16, 1992

[54] STAPLER MECHANISM INCLUDING JAM CLEARING DEVICE

[75] Inventor: Sarwan A. Jairam, Richmond Hll, N.Y.

[73] Assignee: Swingline Inc., Long Island City, N.Y.

[21] Appl. No.: 721,740

[22] Filed: Jun. 26, 1991

[51] Int. Cl.[5] ..... B27F 7/17

[52] U.S. Cl. ..... 227/123; 227/131

[58] Field of Search ..... 227/123, 131

[56] References Cited

U.S. PATENT DOCUMENTS

| | | | |
|---|---|---|---|
| 2,991,476 | 7/1961 | Seiter | 227/123 |
| 3,524,575 | 8/1970 | Hurkmans et al. | 227/123 |
| 4,184,622 | 1/1980 | Spehrley, Jr. | 227/123 |
| 4,200,215 | 4/1980 | Novak et al. | 227/123 |
| 4,436,236 | 3/1984 | Jobe | 227/123 |
| 4,570,841 | 2/1986 | Olesen | 227/131 |
| 4,720,033 | 1/1988 | Olesen | 227/131 |
| 4,913,332 | 4/1990 | Olesen | 227/123 |

*Primary Examiner*—Frank T. Yost
*Assistant Examiner*—Scott A. Smith
*Attorney, Agent, or Firm*—Pennie & Edmonds

[57] ABSTRACT

A stapler with a pivotal sheath which sheath rotation is controlled by a hand-operable control piece. The control piece is anchored to anchor protrusion to place the sheath in its normal operating position. The control piece is releasable from its anchor protrusion to rotate it to assist in releasing jammed staples.

4 Claims, 4 Drawing Sheets

STAPLER MECHANISM INCLUDING JAM CLEARING DEVICE

BACKGROUND OF THE INVENTION

Techniques for clearing jams in staplers have included arrangements for spring mounting of the sheath to allow the sheath to be displaced to accomplish unjamming (U.S. Pat. No. 4,570,841). Another technique has included a crank arrangement to accomplish unjamming (U.S. Pat. No. 4,913,332). Compensating spring and head post mounting of staple blade units are old (U.S. Pat. No. 4,720,033).

None of these arrangements has been satisfactory from both operational and cost standpoints.

SUMMARY OF THE INVENTION

Broadly the present invention comprises an improvement in staplers having a pivotal sheath mounted on the head with the sheath on both sides carrying lower plastic stops and a control piece attached to the sheath for controllably rotating the sheath about its pivot to urge the sheath against such lower stops or to rotate the sheath in the opposite direction to create more space for dejamming. Movement of the control piece forward may be limited by a cavity wall in the head or other control piece stop.

It is a feature that the control piece may be secured in its normal tensioned operating position behind a cartridge.

BRIEF DESCRIPTION OF THE INVENTION

Figure 4A:
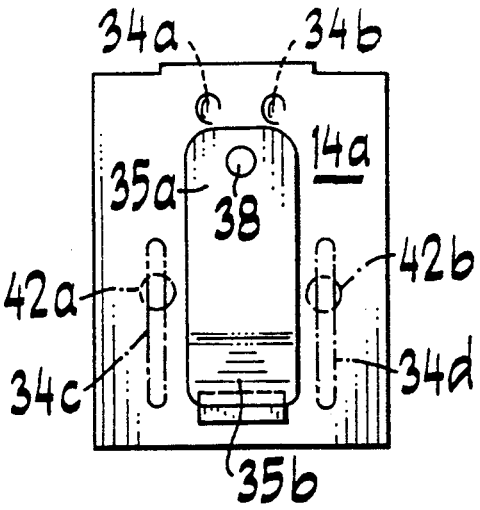
Figure 4B:
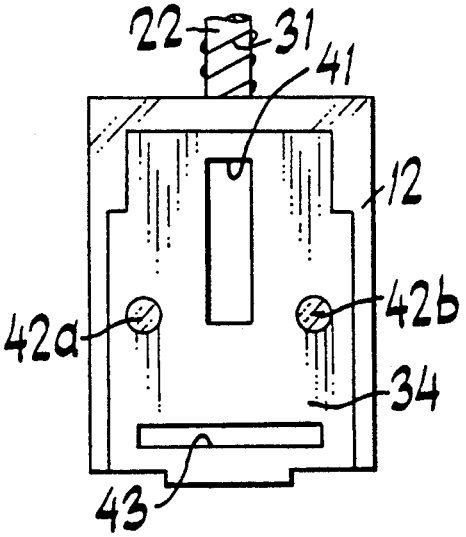
Figure 5:
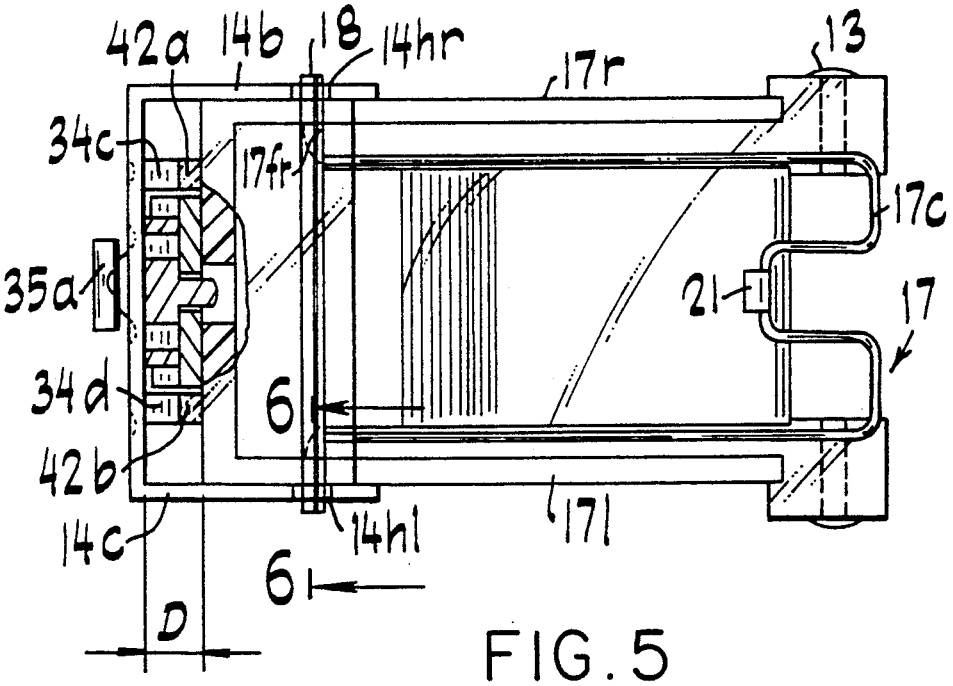

FIG. 4*a* is a front view of the stapler with sheath-mounted leaf spring holding the former block;

FIG. 4*b* is a front view of the head with head plate;

FIG. 5 is a top view of the stapler; and

Figure 6:
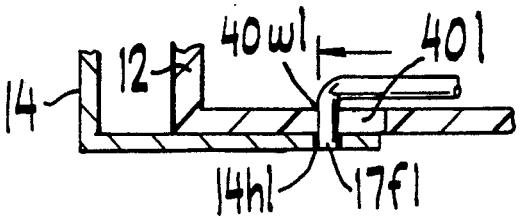

FIG. 6 is a sectional view along line 6—6 of FIG. 5.

DESCRIPTION OF THE PREFERRED EMBODIMENT

Figure 1:
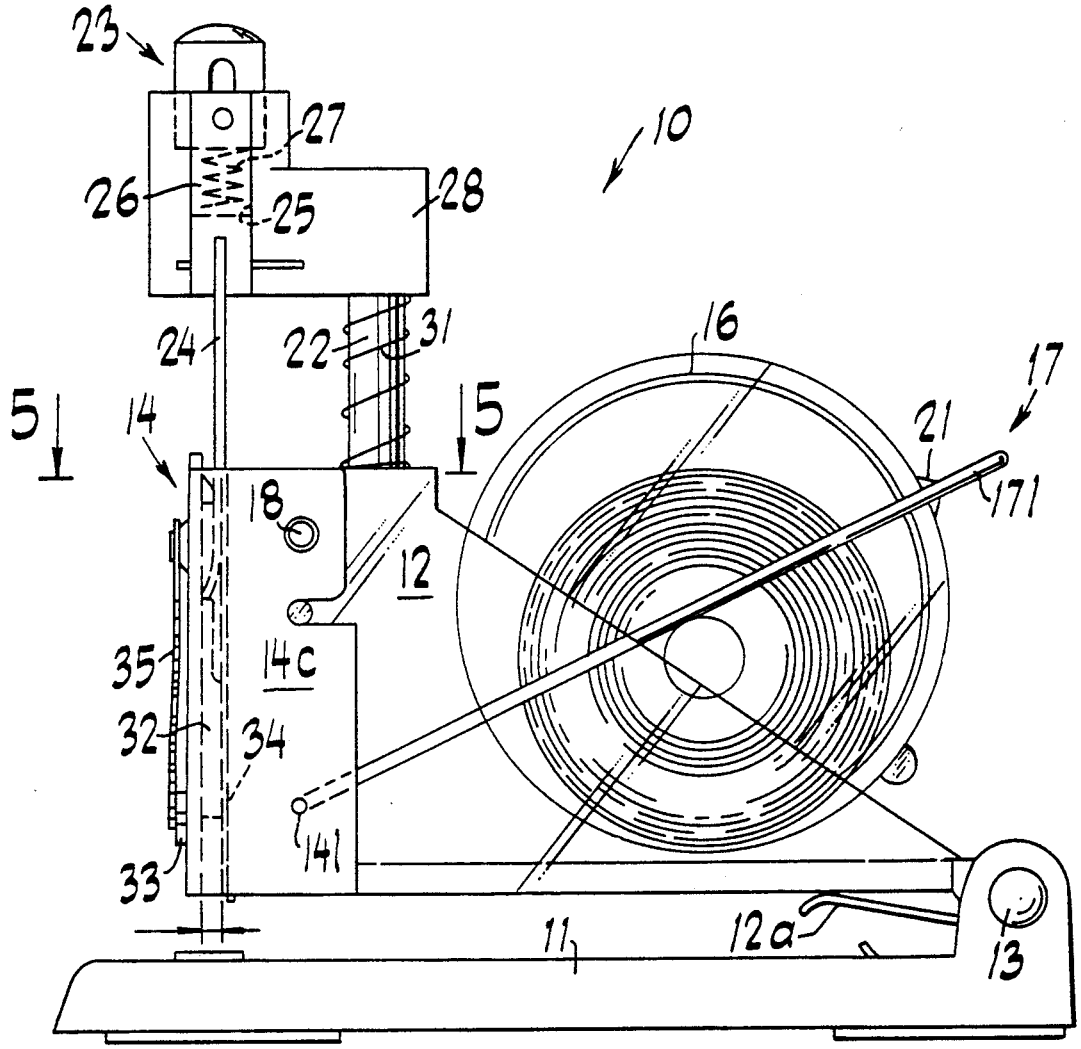
FIG. 1 is a side elevational view of the stapler with a cartridge installed and held in position by a control piece pivotally connected to the sheath.
Figure 2:
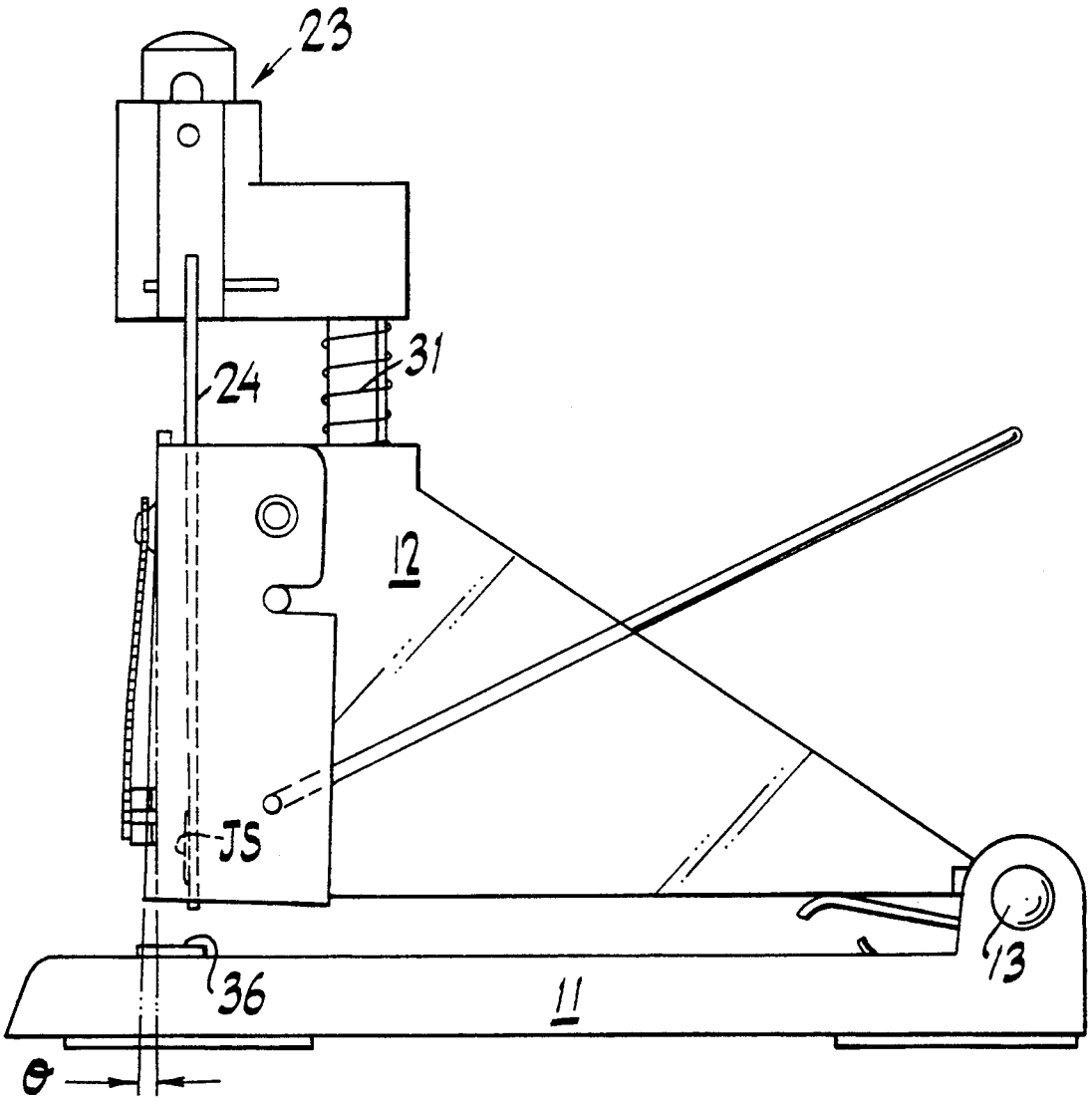
FIG. 2 is a side elevational view of the stapler with a jammed staple and the cartridge removed to free the control piece.
Figure 3:
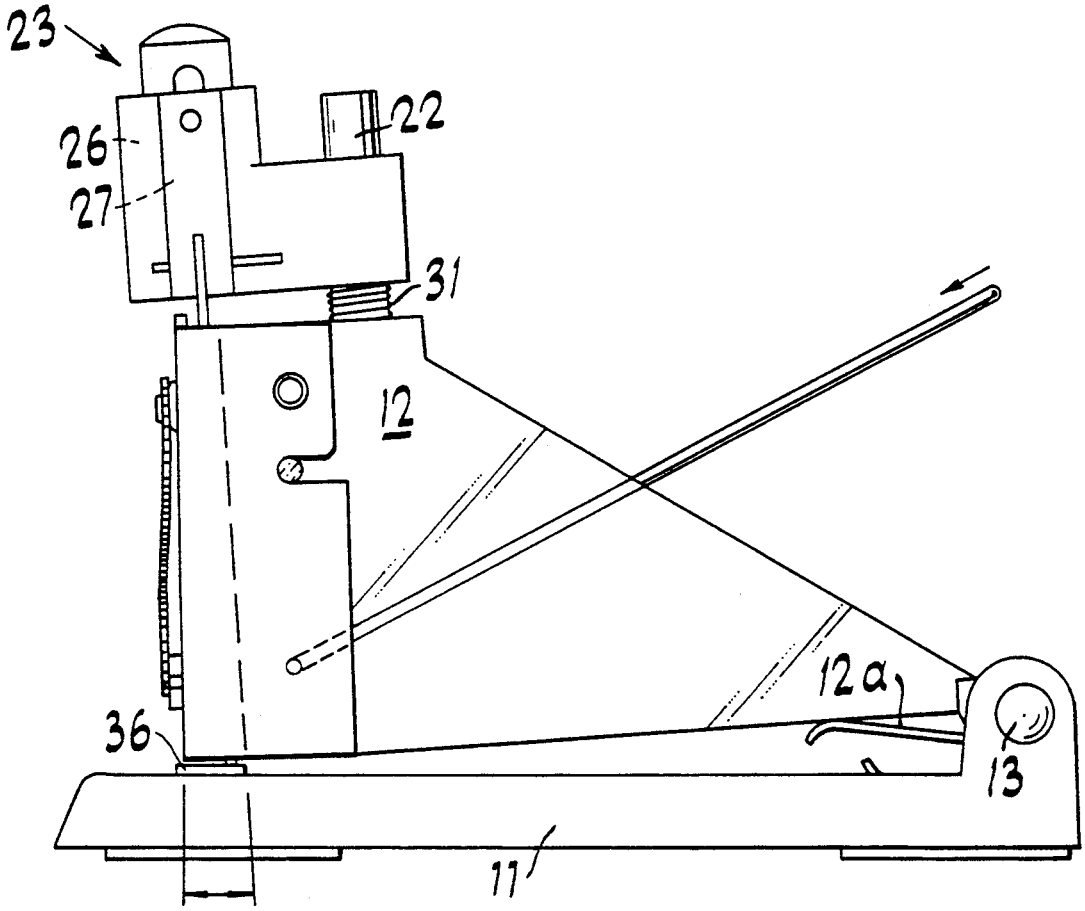
FIG. 3 is a side elevational view of the stapler with the staple driving mechanism being cycled with the cartridge still removed.

In FIGS. 1-3, stapler 10 includes base 11, plastic head 12 pivotal about pivot pin 13, wraparound sheath 14, staple blank containing cartridge 16 and sheath control piece 17. Also shown are axle 18 passing through head 12, cartridge protrusion 21, vertical head post 22, reciprocal driving blade holder unit 23 including driver blade 24, blade housing 26, sheet stack compensation coil spring 27 positioned in housing recess 25, guide sleeve portion 28 and head hold down spring 31. Former plate 32, former block 33, vertical head metal plate 34, front leaf spring 35, head return spring 12*a*, and anvil 36 are also shown. Head plate 34 carries two (2) spaced apart upper former stops 34*a*, *b* and two (2) spaced apart lower guides 34*c*, *d* (see FIGS. 4 and 5).

U-shaped sheath 14 includes front portion 14*a* and side portions 14*b*, 14*c* (see also FIG. 5). Side holes accept axle 18 for mounting of sheath 14 on head 12. Control piece 17 includes right leg 17*r*, left leg 17*l* and crosspiece 17*c*. Legs 17*r*, 17*l* have feet 17*fl* and 17*fr* which fit rotationally into sheath side holes 14*hr*, 14*hl* (FIG. 6).

When control piece 17 is snapped below and behind cartridge protrusion 21, as shown in FIG. 1, sheath front portion 14*a* is urged under the tension of piece 17 to position parallel to plate 34 with sheath lower guides 34*c*, 34*d* abbutting plastic tubular spacers 42*a*, 42*b* respectively so that sheath 14 is spaced a distance D from vertical plate 34 (FIG. 5). Control piece 17 may be, if desired, secured to suitable anchor means on the head other than cartridge 16. Distance D provides sufficient space for normal operation of former unit 32, former block 33 and driver blade 24. When a jam occurs as, for example, the lodging of deformed staple JS shown in FIG. 2, it is necessary to increase the space having dimension D by rotating sheath 14 about axle 18. To accomplish this rotation, control piece 17 is released from holding cartridge 16 or other anchor, leaving sheath 14 free to pivot about axle 18 under the influence of spring 35 to increase distance D until spring feet 17*fr* or 17*lr* or both move in head recesses 40*r*, 40*l* until they engage stop wall 40*wr* or 40*wl* or both thus limiting their forward movement (FIG. 6). In FIG. 1, plate 34 and sheath front 14 are parallel. In FIG. 2 the plate and sheath are at angle $\theta$ to one another to permit unjamming.

Turning to FIG. 3, the stapler head 12, staple blade 24 and former plate 32 have all been moved downwardly through the first half of the stapling cycle to bring blade 24 down against anvil 36. Thereafter, the blade 24, former plate 32 and head 12 are then allowed to return through action of return springs 12*a* and 31 to their rest position of FIG. 1. During this cycle or subsequent cycles, jammed staple (JS) is assisted in being discharged, unless it falls down prior to cycling, onto the staple base 11 for disposal. During such cycling sheath 14 pivots further away from plate 34 until it engages forward-movement stops 40*wr* or 40*wl* of head recesses 40*r*, 40*l*. In this position against such forward stops, head plate 34 and sheath 14 form, as noted above, an angle $\theta$ as shown in FIG. 2.

In FIG. 4*a*, front sheath 14*a* has front spring 35 with upper spring portion 35*a* and lower portion 35*b*. Upper spring portion 35*a* is attached to plate 14*a* with rivet 38. In FIG. 4*b*, head plate 14 has opening 41, plastic tubular spacers 42*a*, 42*b*, and cartridge receiving opening 43. Spring 35 engages block 33 to hold block 33 against sheath 14 (FIG. 1).

FIG. 5 shows the staple in FIG. 1 position with sheath 14 against lower stops 34*c*, 34*d* and FIG. 6 shows right pocket 40*r* in head 12 to provide movement of control piece right foot 17*fr* rearward and forward until it hits stop wall 40*wl*.

I claim:

1. In a stapler having a base, a pivotal stapler head, a head plate, a sheath pivotally mounted on a head axle, the improvement comprising a) a control piece having foot means, said control piece positionable between anchor means on the stapler and side hole means in the sheath to urge the sheath in a first direction to rotate the sheath about the head axle toward the head plate until the sheath engages head stop means; and b) said foot means extending into a head recess having a stop wall so that when the control piece causes the sheath to rotate about the head axle in a direction opposite to the first direction the sheath will rotate until the foot means engage the stop wall.

2. The stapler improvement of claim 1 wherein the head includes a post extension which carries a driving blade and a spring for urging the head upward after downward driving of the blade.

3. The stapler improvement of claim 2 having in addition a second spring urging a forming block toward the head plate which second spring is a leaf spring with one end attached to the sheath and the other free to engage the former block.

4. The stapler improvement of claim 1 in which the stapler head has in addition a staple block cartridge mounted on it and said anchor means is protrusion on the cartridge.

* * * * *